US006799342B1

(12) United States Patent
Jarmon

(10) Patent No.: US 6,799,342 B1
(45) Date of Patent: Oct. 5, 2004

(54) METHOD AND APPARATUS FOR SUPPORTING A BODY

(76) Inventor: Robert G. Jarmon, 8 Brighton Ave., Spring Lake, NJ (US) 07762

( * ) Notice: Subject to any disclaimer, the term of this patent is extended or adjusted under 35 U.S.C. 154(b) by 0 days.

(21) Appl. No.: 10/444,903

(22) Filed: May 27, 2003

(51) Int. Cl.[7] ..... A61G 7/057

(52) U.S. Cl. ..... 5/613; 5/191; 5/933; 601/49; 601/98

(58) Field of Search ..... 5/613, 600, 191, 5/192, 933, 944; 601/49, 98

(56) References Cited

U.S. PATENT DOCUMENTS

| | | | | | |
|---|---|---|---|---|---|
| 2,112,367 | A | * | 3/1938 | Hyter | 601/98 |
| 3,464,406 | A | | 9/1969 | Kunce | 128/57 |
| 4,202,326 | A | | 5/1980 | Van Gerpen | 128/33 |
| 4,494,260 | A | | 1/1985 | Olds et al. | 5/446 |
| 4,625,487 | A | | 12/1986 | Blakeway | 5/446 |
| 4,769,864 | A | * | 9/1988 | Park | 5/190 |
| 4,958,627 | A | | 9/1990 | Park | 128/33 |
| 4,999,861 | A | * | 3/1991 | Huang | 5/600 |
| 5,161,267 | A | | 11/1992 | Smith | 5/88 |
| 5,233,712 | A | * | 8/1993 | Jurus et al. | 5/613 |
| 5,626,555 | A | * | 5/1997 | Di Blasi et al. | 601/98 |
| 5,659,910 | A | * | 8/1997 | Weiss | 5/618 |
| 5,776,048 | A | | 7/1998 | Jo | 600/21 |
| 6,009,873 | A | | 1/2000 | Neviaser | 128/845 |

* cited by examiner

*Primary Examiner*—Alexander Grosz
(74) *Attorney, Agent, or Firm*—Thomas L. Adams

(57) ABSTRACT

A body support that can prevent bed sores (decubiti) has a first frame with a first plurality of parallel bands, and a second frame with a second plurality of parallel bands. The first plurality of bands is interdigitated with the second plurality of parallel bands. A driver can reciprocate the first plurality of parallel bands, and the second plurality of parallel bands. The driver produces relative motion between the first and the second plurality of parallel bands. A replacement band can be attached end to end with a selected one of the bands of the first and the second plurality of parallel bands. Then the selected one of the bands can be pulled in a direction to insert the replacement band into a position originally occupied by the selected one of the bands.

24 Claims, 3 Drawing Sheets

METHOD AND APPARATUS FOR SUPPORTING A BODY

BACKGROUND OF THE INVENTION

1. Field of the Invention

The present invention relates to therapeutic body supports, and in particular, to supports having reciprocating elements.

2. Description of Related Art

Bedridden patients being treated in the hospital or at home can develop bedsores (decubiti) under certain conditions. The Braden Scale evaluates the risk of sores by scoring six categories: (1) The ability of the patient to respond meaningfully to pressure-related discomfort, which may decline as a result of sedation, a diminished level of consciousness, or a limited ability to feel pain. (2) The degree of exposure of the skin to moisture from perspiration, body fluids, etc. (3) The amount of physical activity performed by the patient. (4) The patient's ability to change and control body position. (5) The adequacy and quality of the patient's diet. (6) How often the patient moves or must be moved in a way that causes friction and shear forces.

One of the prime contributors to skin breakdown that causes decubiti, is the bill-up of moisture between the patient's skin and the bedding on which the patient is resting (Braden Scale).

Insensible water loss from a body is approximately 50 ml /hour ("*Textbook of Medical Physiology*' Guyton & Hall, 2000). When a patient is febrile, the amount of moisture exuded through the skin can increase dramatically. If the patient is also incontinent of bowel and/or bladder, more fluids are exuded and act to increase the damage of shear on skin which promotes decubiti formation.

Existing hospital beds do not allow for free flow of air under the patient. One typically expensive model by Hill-Rom incorporates a mechanical flow of air but is predicated on existence of continual electrical power.

Keeping skin temperature down will also reduce the risk of decubiti. Unfortunately, known bedding systems do not incorporate effective features for reducing or moderating skin temperature.

The prediction of porosity or permeability of fabrics via theoretical models has proven somewhat frustrating (*The Relationship Between Porosity and Air Permeability of Woven Textile Fabrics*, Epps & Leonas, *Journal of testing and Evaluation*, Vol. 25, 1997, pp 108–113). Fortunately the measurement of air and moisture is not, and is available for the common fabrics (sheeting, print cloth, flannel, sateen, plain weave, batiste, poplin, and the synthetics: taffeta, challis, and plain weave triacetate).

Rather complicated beds are available for providing a body support that reduces the tendency for bedsores. These beds provide continually changing pressure points that prevent stasis. However, these beds are not widely available because their complexity and cost make them impractical for widespread use in most hospitals, as well as being beyond the financial reach of most home users. Moreover, these beds have many drawbacks in that they do not promote adequate air circulation around the patient, are not easily dismantled for set up or cleaning, cannot be easily operated manually during a power failure, etc.

In U.S. Pat. No. 5,776,048 a burn patient lies on a row of fixed bars 38 interleaved with reciprocating bars 43. The reciprocating bars rise above and descend below the fixed bars to prevent bedsores. The bars have a removable core that can be removed for washing.

In U.S. Pat. No. 4,625,487 a number of transverse cushions are held in cradles to form a bed. Alternate cradles can be rocked in opposite directions to produce alternating lift points that can massage a person and prevent bedsores. See also U.S. Pat. No. 4,494,260 where cradled cushions are all rocked in the same direction.

In U.S. Pat. No. 3,464,406 a bed surface is supported by a number of parallel rods 100, each mounted between an opposite pair of planetary gears 90. The rods 100 are mounted eccentrically and at different phases so that when gears 9 are rotated, the rods produce a wave-like motion.

In FIG. 5 of U.S. Pat. No. 4,999,861 a bed surface is formed from a number of parallel slats 18 with rollers that ride on cams 64, which are phased to produce a wave-like motion. See also U.S. Pat. No. 4,202,326.

In. U.S. Pat. No. 4,958,627 a bed is formed of a number of parallel wires 13. A motor-driven cam swings a lever 32 (FIG. 3) to periodically hit and lift the wires 13 as shown in the upper left portion of FIG. 2.

In U.S. Pat. No. 5,161,267 a patient is lifted by a number of parallel straps in order to change bed linens.

In U.S. Pat. No. 6,009,873 a pair of inflatable wedges are placed on opposite sides of a patient and held in place with encircling straps to maintain the patient's position.

Accordingly, there is a need for an improved body support and method for supporting a body that can provide a beneficial effect, such as preventing bedsores.

SUMMARY OF THE INVENTION

In accordance with the illustrative embodiments demonstrating features and advantages of the present invention, there is provided a body support for providing a beneficial effect. The support includes a first frame having a first plurality of parallel bands, and a second frame having a second plurality of parallel bands. The first plurality of bands is interdigitated with the second plurality of parallel bands. Also included is a driver for reciprocating the first plurality of parallel bands, and the second plurality of parallel bands. The driver produces relative motion between the first and the second plurality of parallel bands.

In accordance with another aspect of the present invention a method is provided that employs a first plurality of parallel bands and a second plurality of parallel bands to support a body while preventing bed sores. The method includes the step of interdigitating the first plurality of bands with the second plurality of parallel bands. Another step is reciprocating the first plurality of parallel bands, and the second plurality of parallel bands by producing relative motion between the first and the second plurality of parallel bands.

In accordance with yet another aspect of the present invention a method is provided that employs a first plurality of parallel bands and a second plurality of parallel bands to support a body while preventing bed sores. The method includes the step of interdigitating the first plurality of bands with the second plurality of parallel bands. Another step is producing relative motion between the first and the second plurality of parallel bands. The method also includes the step of attaching a replacement band end to end with a selected one of the bands of the first and the second plurality of parallel bands. Another step is pulling the selected one of the bands in a direction to insert the replacement band into a position originally occupied by the selected one of the bands.

In a preferred embodiment two separate frames will be fitted with parallel bands. This arrangement will allow bands from one frame to interdigitate with the bands from the other frame. The two frames will be mounted in a support structure and reciprocated with such phasing that bands from one frame will be reaching a peak while bands from the other frame will be reaching a low point. In this preferred embodiment both frames will be moving relative to the support structure and will maintain the bands at an approximately constant average elevation so that a patient lying on the body support will not have the uncomfortable feeling of rising and falling.

Preferably, the parallel bands will be flexible strips that are releasably fastened on opposite sides of their respective frames. This will allow periodic removal of the parallel bands for cleaning or replacement. Preferably, the frames can be placed in positions allowing access to the regions where the bands are attached to the frame to facilitate removal and replacement of the bands. In one preferred arrangement, one end of a replacement band is attached to an end of an original band using a discardable fastener. Thereafter, the original band can be withdrawn in a direction to pull the replacement band into the position previously occupied by the original band.

Apparatus and methods of the foregoing type can be designed to allow air circulation under a patient at all times, even with the motor off, thereby preventing moisture build-up, which is a prime contributor to the development of decubiti (bed sores). Also, preferred embodiments can be designed with an oscillating action that acts as an external heart pump to help blood flow.

Components of the preferred embodiments, when arranged as a bed, can be dismantled for ease of setting up. Also, the underlying bands act as a bedding that can be changed without moving the patient. In the preferred embodiments, the supporting straps can be easily changed for improved sanitation, thereby decreasing the chance for microbial pathogens to infect a patient.

In case of electrical failure or motor failure, the preferred bed oscillating mechanism can be operated in a manual mode, with pressure shifting preserved.

Because the preferred body support is less heavy and can be disassembled, less time is required to move it in and out of a patient's bedroom. Because the preferred body support can be made from standard components (steel frames, fabric straps, gears, motors, grommets, etc.), it is much easier and less costly to manufacture. Also, because the preferred design is of a simpler nature, costly technical maintenance is reduced. Consequently, more patients will have access to this modality, and thereby more pathology will be successfully treated or prevented.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
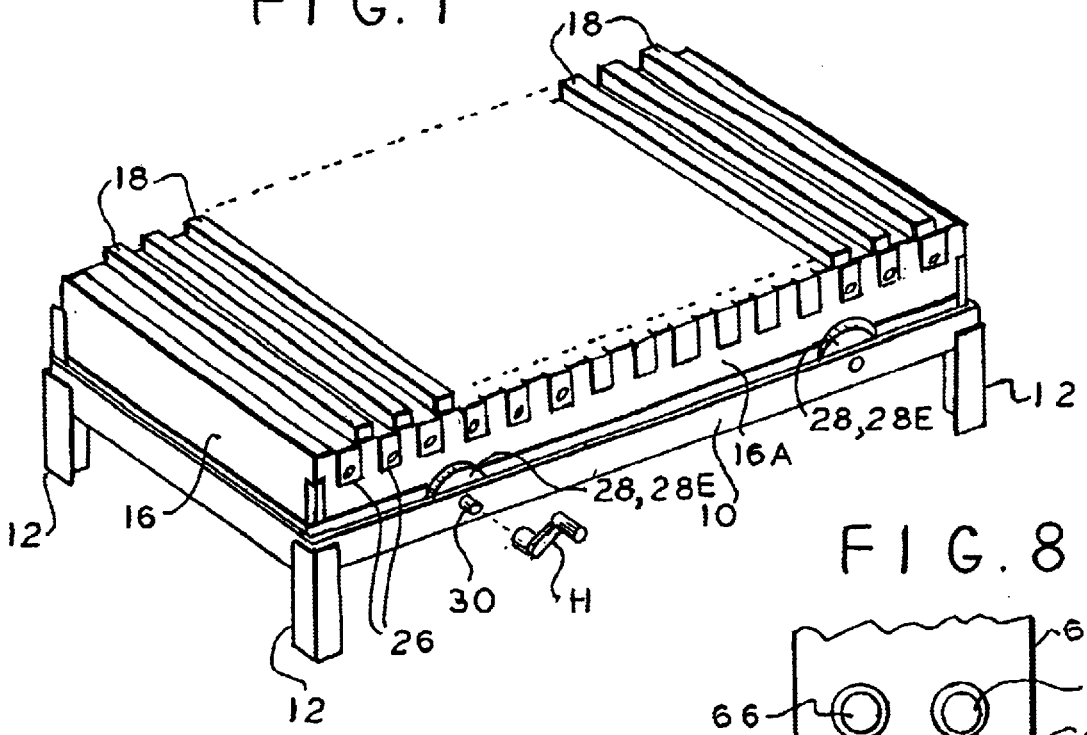
FIG. 1 is a perspective view of a body support demonstrating principles and methods of the present invention.

Referring to FIGS. 1–4, a body support is shown as a support structure having a chassis 10 supported by four legs 12. Support structure 10/12 is an open frame reciprocatably supporting a first frame 14 and a second frame 16, with first frame 14 nested inside frame 16. Both frames 14 and 16 are open rectangular structures each formed from four slats. In this embodiment the two longer slats 14A of frame 14 constitute a pair of serrated slats. Specifically, the serrations are illustrated herein as square projections 14B alternating with square gaps 14C. The corresponding longer slats 16A of frame 16 are not serrated but may be in other embodiments, as described hereinafter.

Mounted transversely across frame 14 on each of the projections 14B of the slats 14A are a first plurality of parallel bands 18. The bands 18 may be cloth strips made of linen, canvas, or other fabrics made of natural or synthetic fibers. Alternatively, bands 18 may be continuous plastic strips or composite materials with a certain amount of elasticity. In still other embodiments, each of the bands 18 may be formed of a separate number of smaller strips or cords. In some embodiments, the bands may be formed of multiple layers that have different purposes; for example, an absorbent upper layer on top of a lower layer having a desired amount of strength and elasticity. In some embodiments, bands may be sold on a roll and may be cut into discrete bands with scissors.

In most embodiments, the width of the bands will be between 0.5 to 12 inches (1.3 to 30.5 cm); but preferably the range will be 1 to 2 inches (2.5 to 5.1 cm). In any event, it is desirable to have bands that allow the passage of air, vapor and liquids to reduce the amount of moisture that can be trapped between a person's body and one of the bands.

Reducing the moisture at a patient's skin is highly desirable. In the absence of fluid excretion from incontinence or other such causes, insensible water loss will be a dominant factor in determining skin moisture. This moisture is directly affected by the air permeability of the bands. Keeping air permeability greater than 9 $cm^3/cm^2/sec$ is desirable and, preferably, the air permeability will be greater than 50 $cm^5/cm^2/sec$. In one highly preferred embodiment, the bands are made of a plain weave of triacetate fibers or other synthetic fibers having an air permeability exceeding 130 $cm^3/cm^2/sec$, although the use of other types of fabrics is anticipated. Air permeability will be measured as described in *The Relationship Between Porosity and Air Permeability of Woven Textile Fabrics*, Epps & Leonas, *Journal of testing and Evaluation*, Vol. 25, 1 997, pp 108–113.

The bands in the present bed can be of various strengths as needed without compromising moisture evaporation, or the effects of wicking or osmotic movement.

Also, since the bands are relatively permeable, thin, and have small gaps between them, the overall air permeability is relatively high. Moreover, the same factors work to keep skin temperature down and therefore help to reduce the risk of decubiti.

The illustrated bands 18 have at each end a hole 20 reinforced with a metal grommet 22. In other embodiments the hole may be reinforced by one or more rings that are mounted concentrically around the hole and are secured in place by glue, heat sealing, etc. A stud 24 with an enlarged head is mounted on the outside of slats 14A to provide a nail-like structure that can be inserted into hole 20 of bands 18. Preferably, bands 18 are sized and have a certain amount of elasticity so that the band 18 can be stretched slightly to reach the studs 24 on both slats 14A. After being landed on the studs 24 bands 18 can be released and will retract to the position shown in FIG. 3 so that the enlarged head of stud 24 will prevent hole 20 and grommet 22 from sliding off the stud.

A second plurality of parallel bands 26, identical to bands 18, are mounted transversely across frame 16 on the two slats 16A. Mounted on the outside of slats 16A are studs 24, which are identical to the studs on the outside of slats 14A, and are arranged to fit into the holes 28 on bands 26. The length of the bands 18 and 26 will be chosen depending upon the width of the frames 14 and 16. Studs 24 will be positioned on slats 14A and 16A so that bands 18 and 26 will have the same lengths and, therefore, may be identical.

Figure 6:
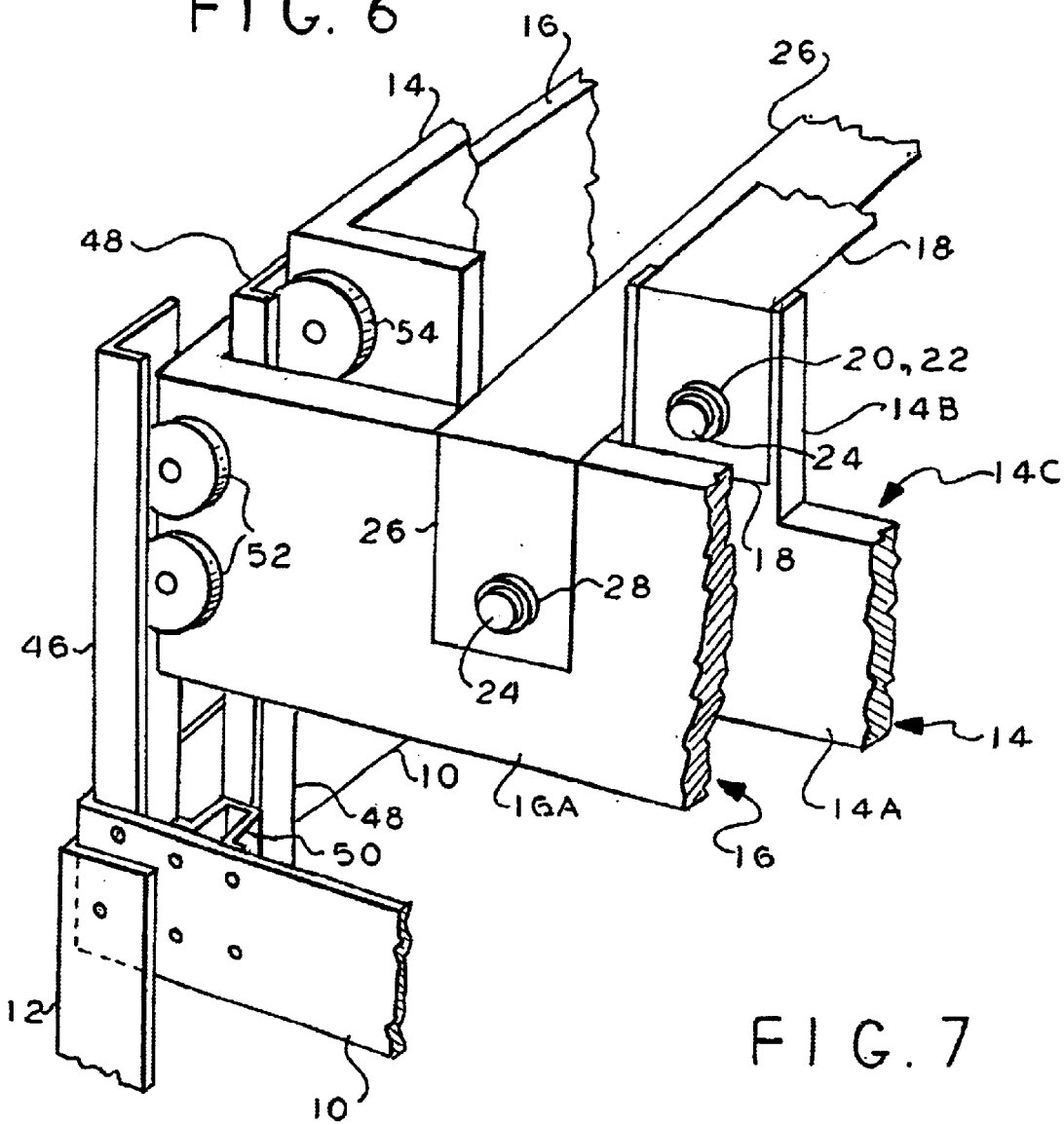
FIG. 6 is detailed, fragmentary, perspective view of one of the corners of the body support of FIG. 1.
Figure 4:
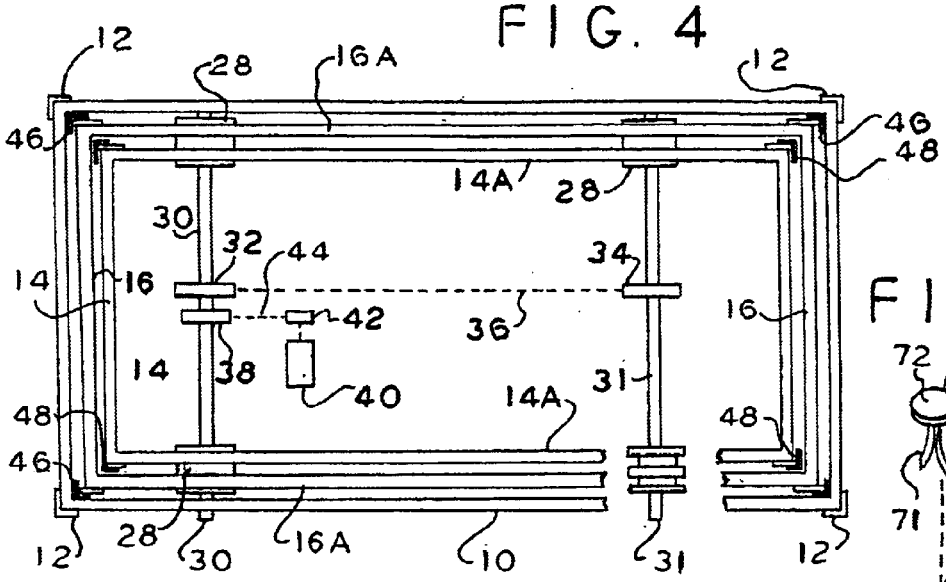
FIG. 4 is a plan view of the body support of FIG. 1 with a portion broken away to expose one of the lifting cams.
Figure 5:
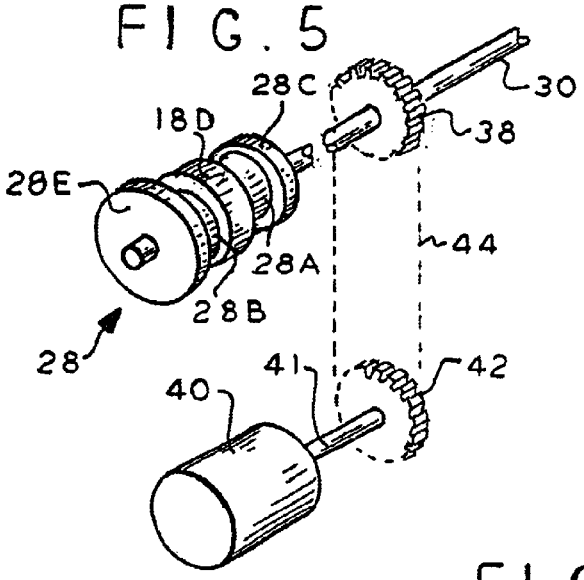
FIG. 5 is a detailed, fragmentary, perspective view of the driver and and a cam of FIG. 3.

Referring to FIGS. 4–6, drive shafts 30 and 31 are transversely and rotatably mounted in support chassis 10 under frames 14 and 16. Mounted on either end of drive shafts 30 and 31 are four double-track cams 28, which act as a driver for lifting frames 14 and 16. Each of the cams 28 has an inner camtrack 28A for lifting frame 14 and an outer camtrack 28B for lifting frame 16. Tracks 28A and 28B are separated by concentric cylindrical member 28D and are bordered on the outside by concentric cylindrical members 28C and 28E, respectively.

Tracks 28A and 28B are essentially cylindrical bodies that are mounted eccentrically relative to shafts 30 and 31. Tracks 28A and 28B have the same shape but are phased 180° apart. Accordingly, cams 28 can lift frame 14 to a peak while lowering frame 16 to a low point, and vice versa. Therefore, cams 28 can continuously reciprocate frames 14 and 16 while keeping their average height essentially constant.

The phasing of the cams 28 on the two shafts 30 and 31 are controlled by an endless chain 36 that circulates on gears 32 and 34 on shafts 30 and 31, respectively. The shaft 30 and therefore shaft 31 are driven by electric motor 40 whose drive shaft 41 rotates drive gear 42, which in turn rotates gear 38 on shaft 30, by means of endless chain 44.

Mounted in the inside corners of chassis 10 are vertical guide rails 46, shown herein as angle irons. Another four vertical guide rail 48 are separately mounted on a bracket such as bracket 50, which is attached to the inside of chassis 10. The four guide rails 48 are located at a position diagonally inward from guide rails 46. A pair of guide wheels 52 mounted on slats 16A project beyond frame 16 and ride in guide rails 46. A similar pair of guide wheels 54 (only one shown in FIG. 6) also project beyond frame 14 and ride in guide rails 48.

Figure 7:
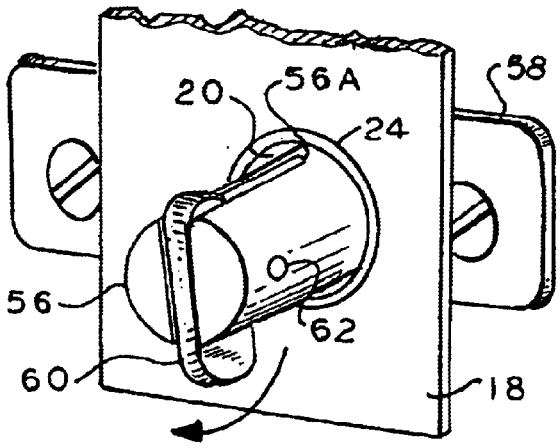
FIG. 7 is a detailed perspective view of a device for attaching a band that is an alternate to that of FIG. 6.
Figure 3:
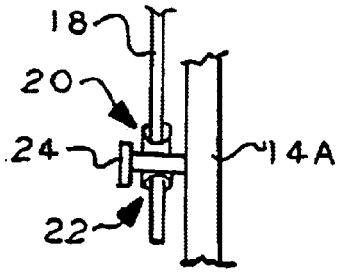
FIG. 3 is a detailed elevational view showing the attachment of one of the bands of FIG. 1 to a supporting frame.

Referring to FIG. 7, an alternate means for fastening previously mentioned band 18 is illustrated. Slotted stud 56 is integrally molded on base 58, which is screwed into previously mentioned slats 14A or slats 16A. A pendulous lever 60 is pivotally mounted in slot 56A on pivot pin 62. Band 18 can be installed on the stud 56 by lifting lever 60 to a horizontal position and sliding the hole 20 of band 18 over stud 56. Thereafter, lever 60 can be rotated to the illustrated position to prevent band 18 from sliding off stud 56.

Figure 8:
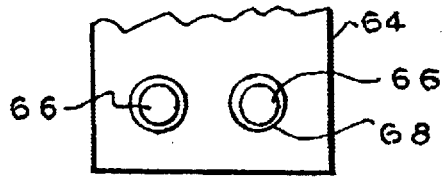
FIG. 8 is a detailed fragmentary view of an end of a band that is an alternate to that shown in FIG. 1.

Referring to FIG. 8, an alternate band 64 is made of a strip of material that is the same as for bands 18 and 26. Band 64 is wider and has a pair of holes 66 that can slide over a pair the studs similar to that illustrated in the previously mentioned figures.

Figure 2A:
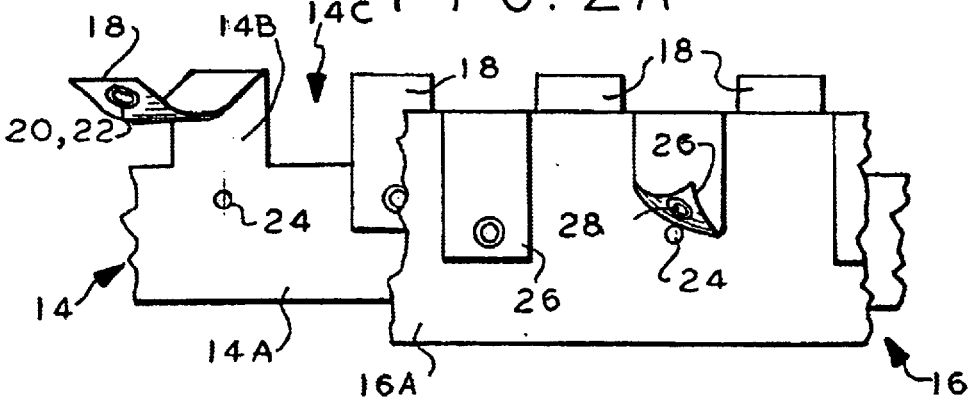
FIG. 2A is a detailed fragmentary view of a portion of the body support of FIG. 1 showing a first frame higher than a second frame.
Figure 2B:
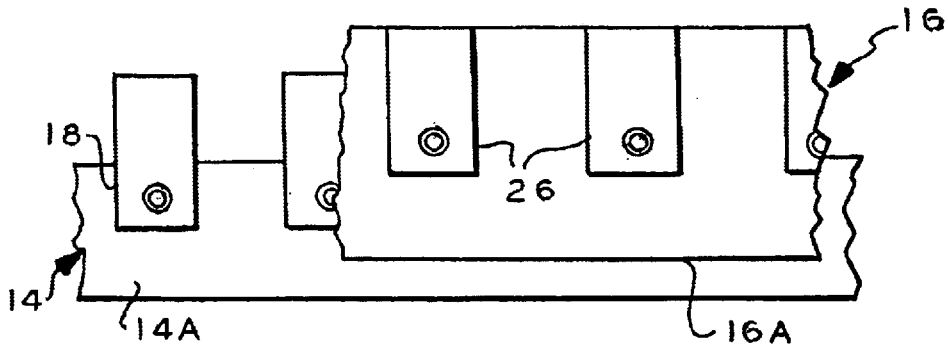
FIG. 2B is a detailed fragmentary view of a portion of the body support of FIG. 1 showing the second frame higher than the second frame.
Figure 9:
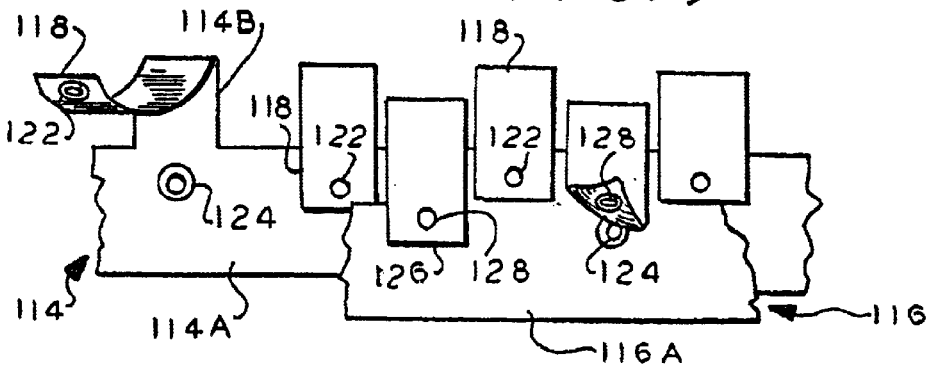
FIG. 9 is a detailed fragmentary view of a portion of a body support that is an alternate to that shown in FIG. 2A.

Referring to FIG. 9, elements corresponding to those shown in FIG. 2A bear the same reference numeral but increased by 100. Thus, frame 114 has a slat 114A serrated with rectangular projections 114B. Band 118 is similar to that previously illustrated, except for having a snap 122 at each end designed to snap over snap stud 124 on slat 114A. In this embodiment slat 116A for frame 116 is serrated in the same way as slat 114A. Bands 126 are fastened on the rectangular projections of slat 116A by means of snap fasteners 128, which snap onto snap studs 124. It should be noted that when slat 116A is serrated fasteners 122 are readily exposed without the need to raise frame 114 very high.

To facilitate an understanding of the principles associated with the foregoing apparatus, its operation will be briefly described. A bedsheet may be placed on the body support of FIG. 1 over the bands 18 and 26. Thereafter, a patient may be placed on the bedsheet and will be supported by bands 18 and 26. Preferably, bands 18 and 26 will have a certain amount of elasticity so that the patient will be supported comfortably. The motor 40 may be started to rotate gears 42, 38, 32, and 34. Consequently, shafts 30 and 31 will rotate all four cams 28 synchronously.

Since cam tracks 28A and 28B are phased 180° apart the bands 18 will be rising when bands 26 are descending (and vice versa). The resulting motion of frames 14 and 16 (and thus bands 18 and 26) will preferably be sinusoidal with a 180° phase shift, although other time profiles are possible. It is highly desirable to keep the average height of bands 18 and 26 constant to avoid giving the person lying on the bands the uncomfortable feeling of rising and falling. Preferably, the speed of motor 40 can be adjusted to accommodate the specific needs of the patient using the body support. The speed of motor 40 can be adjusted to give bands 18 and 26 a period of five seconds to two hours.

Preferably, the space between adjacent ones of the bands 18 and 26 will be kept very small so that a person lying on the bands will not feel gaps. However, a small gap will be desirable to avoid having locations on the patient's body that always experience support pressure. Also, allowing a small gap will avoid pinching, but sheets or other covers can be placed over the bands to reduce or eliminate pinching as well.

The amplitude of the bands 18 and 26 will be at least 0.5 inch (1.3 cm), and preferably in the range of 0.5 to 1.5 inches (1.3 to 3.8 cm). For example, with an amplitude of 0.5 inch one set of bands may rise 0.5 inch above an average position while the other set of bands descend to a position 0.5 inch below that average position. The amplitude will be selected depending on the condition of the patient and the thickness and resiliency of any covers between the patient and the bands 18 and 26. In any event, the bands 18 and 26 will reciprocate in such a way as to the provide support from one set of bands while the other set of bands retracts just enough to take pressure off the patient.

In some embodiments, the amplitude will be chosen to raise frame 14 sufficiently to expose the stud 24 holding the band 18. In other embodiments, there will be sufficient clearance between slats 14A and 16A to allow access to the fastening stud, in which case then studs 24 on slats 14A need not be elevated above slats 16A.

It is highly desirable to periodically replace bands 18 and 26. Frames 14 and 16 can be locked into position in preparation for replacement by employing an appropriate brake (not shown) or by simply inserting a pin (not shown) between frames 14 and 16 that lock them in position.

Removed bands can either be discarded or washed, depending upon the comparative economics of washing vs. disposal. In some instances the patient as well as any bed sheets or coverings may be removed from the body support. In this case, the bands 18 and 26 can be pulled on one end to shift the respective holes 20 or 28 so they can be slid off the studs 24. (Similar procedures apply for unfastening the bands from the fasteners of FIG. 7 and 9.) Thereafter, replacement bands identical to those just removed can be installed by slipping the hole 20 or 28 over a stud 24 on one side, and then stretching the band to slip the opposite hole over the stud 24 on the opposite side.

Figure 10:
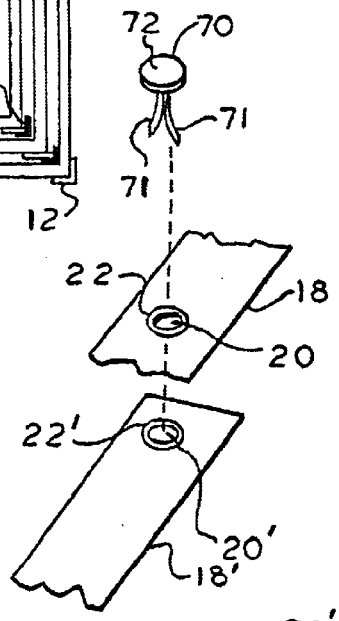
FIG. 10 illustrates a method of attaching one of the bands of FIG. 1 to a replacement band using a fastener.

Often, bands 18 and 26 must be replaced while the patient remains on the bed support. In this case one may unfasten one end of a band 18 or 26 and then attach a replacement band to the unfastened end of the original band, thereby affecting an end to end attachment. This process is illustrated in FIG. 10 wherein the end of band 18 is unfastened and the replacement band 18' is positioned so that the respective holes 28 and 20' are aligned. Preferably, the replacement band 18' is sold with a disposable fastener 70 in hole 20'.

Fastener 70 is shown herein with a pair of bendable metal legs 71 projecting from a head 72. Fasteners of this type are commercially available and are used for fastening loose leaf paper together into a report. Alternate fasteners are contemplated, such as a cuff link-like device or a device similar to those used for key rings (e.g., semicircular elements hinged together and having distal barbs that snap together to close the ring). Also, an installer can use a stapler to fasten two bands together end to end.

Before installation, fastener 70 is removed and the holes 20 and 20' are aligned before inserting fastener 70 through the two holes 20 and 20' in order to connect bands 18 and 18' end to end. Thereafter, original band 18 can be pulled from the body support in a direction to draw replacement band 18' into the position originally occupied by original band 18. Once replacement band 18' is in place fastener 70 may be removed and discarded. Replacement band 18' is then installed by slipping hole 20' on one end of the band over a stud 24 and then slipping the opposite hole 20' over a stud 24 on the opposite side.

This procedure may be repeated for some or all of the bands 18, as well as for some or all of the bands 26. In some instances only bands that are worn or soiled will be replaced. In other instances, bands will be replaced to provide a different effect. For example, some patients may require a more resilient surface and therefore bands with a greater ability to stretch will be installed. In other cases, patients may require bands that are more porous. In some cases certain neighborhoods of the bands will be replaced to provide a different surface for different portions of the patient's body.

Figure 11:
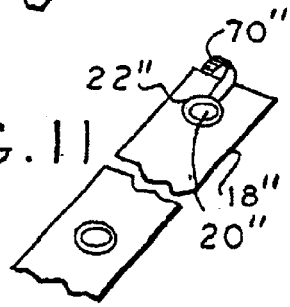
FIG. 11 illustrates a band that is an alternate to the bands of FIG. 1.

In the alternate embodiment of FIG. 11, band 18" is identical to previously mentioned band 18, except that grommet 22" is made with an integral hook 70". Consequently, band 18" can be used as a replacement with hook 70" inserted into the hole 20 of band 18 (compare to FIG. 10). Hook 70" will allow replacement band 18" to be pulled into the position formerly occupied by the original band.

A handcrank H is shown in FIG. 1 to be used in case of power failure or if one wishes to manually adjust the position of frames 14 and 16 in preparation for band replacement. Shaft 30 is relatively long and projects to the outside of chassis 10. The end of shaft 30 can have a polygonal perimeter or can be splined to allow handcrank H to engage and crank shaft 30.

It is appreciated that various modifications may be implemented with respect to the above described, preferred embodiments. While the preferred bands reciprocate slowly and continuously, in other embodiments they may move intermittently at a higher speed. Instead of transverse bands, some embodiments may have bands that run longitudinally or diagonally. While camshafts are shown engaging the longer sides of frames 14 and 16, in other embodiments they may engage the shorter sides. Instead of cams, some embodiments may employ a crank wheel with diametrically opposed studs on opposite sides of the crank wheel that engage horizontal slots in the frames 14 and 16 in order to reciprocate those frames. In still other embodiments frames 14 and 16 may be reciprocated by hydraulic pistons, lead screws, rack and pinon mechanisms, etc. Instead of guide wheels riding on guide rails, frames 14 and 16 may have collars that slide on stationary upright rods. Some embodiments may employ a bedpan that is located under the bands to keep body fluids out of the reciprocating mechanism.

Obviously, many modifications and variations of the present invention are possible in light of the above teachings. It is therefore to be understood that within the scope of the appended claims, the invention may be practiced otherwise than as specifically described.

What is claimed is:

1. A body support for providing a beneficial effect comprising:

a first frame having a first plurality of parallel bands;

a second frame having a second plurality of parallel bands, said first plurality of bands being interdigitated with said second plurality of parallel bands, said bands being connected to said first and said second frame at end portions thereof, with central portions of at least some of the bands being free from attachment to said first and said second frame; and a driver for reciprocating (1) said first plurality of parallel bands, and (2) said second plurality of parallel bands, said driver producing relative motion in the vertical direction between said first and said second plurality of parallel bands.

2. A body support according to claim 1 wherein said driver is operable to reciprocate said first and said second plurality of parallel bands to produce continuous motion.

3. A body support according to claim 1 wherein said driver is operable to reciprocate said first and said second plurality of parallel bands to keep the average height of said first and said second plurality of parallel bands approximately constant.

4. A body support according to claim 1 wherein said first frame has a first pair of serrated slats, said first plurality of parallel bands being transversely suspended between said first pair of slats.

5. A body support according to claim 4 wherein said second frame has a second pair of serrated slats, said second plurality of parallel bands being transversely suspended between said second pair of slats.

6. A body support according to claim 1 further comprising:

a support structure; and at least one cam rotatably mounted on said support structure to engage and lift one of said first and said second frames.

7. A body support according to claim 1 further comprising:

a support structure, said driver including a plurality of cams rotatably mounted on said support structure to engage and lift said first and said second frames, said plurality of cams being phased to lift said first frame with a timing different than that of said second frame.

8. A body support according to claim 7 wherein said first and said second frames each have four corners, said plurality of cams being located separately near the four corners of said first and said second frames, said plurality of cams being linked to rotate synchronously.

9. A body support according to claim 8 wherein said support structure comprises:

four guide rails located separately near the four corners of the first frame for guiding said first frame.

10. A body support according to claim 9 wherein said first frame has a plurality of guide wheels positioned to ride on said four guide rails.

11. A body support according to claim 1 wherein said first and said second plurality of bands are removably attached to said first and said second frame, respectively.

12. A body support according to claim 11 wherein said first and said second frames each have a plurality of studs with enlarged heads, said first and said second plurality of bands being adapted to attach to said plurality of studs.

13. A body support according to claim 11 wherein said first and said second frames each have a plurality of slotted studs each with a pendulous lever pivotally mounted in said stud, said first and said second plurality of bands being adapted to attach to said plurality of studs.

14. A body support according to claim 11 wherein said first frame is located inwardly relative to said second frame.

15. A body support according to claim 14 wherein said first and said second frames each have a plurality of studs with enlarged heads, said first and said second plurality of bands being adapted to attach to said plurality of studs.

16. A body support according to claim 15 wherein said first frame is moveable by said driver to a height sufficient to expose said studs on said first frame from behind said second frame.

17. A body support according to claim 1 wherein the bands of said first and said second plurality of bands each have a hole on one end and on an opposite end a hook.

18. A body support according to claim 1 comprising a plurality of replacement bands for replacing the bands of said first and said second plurality of bands, each of said replacement bands having a pair of opposing holes, and a disposable fastener, the disposable fastener adapted to temporarily join end to end one of the replacement bands to one of the bands of said first and said second plurality of bands.

19. A method employing a first plurality and a second plurality of parallel bands in separate respective frames to support a body while preventing bed sores, comprising the steps of:

connecting end portions of said bands to said frames with central portions of at least some of said bands free from attachment to said frames;

interdigitating said first plurality of bands with said second plurality of parallel bands; and vertically reciprocating (1) said first plurality of parallel bands, and (2) said second plurality of parallel bands by producing relative motion between said first and said second plurality of parallel bands.

20. A method according to claim 19 wherein reciprocation of said first and said second plurality of parallel bands is performed by moving said first and said second plurality of parallel bands continuously.

21. A method according to claim 19 wherein reciprocation of said first and said second plurality of parallel bands is performed to keep the average height of said first and said second plurality of parallel bands approximately constant.

22. A method employing a replacement band, a first plurality of parallel bands and a second plurality of parallel bands to support a body while preventing bed sores, comprising the steps of:

interdigitating said first plurality of bands with said second plurality of parallel bands;

producing relative motion between said first and said second plurality of parallel bands;

attaching the replacement band end to end with a selected one of the bands of the first and the second plurality of parallel bands; and pulling the selected one of the bands in a direction to insert the replacement band into a position originally occupied by the selected one of the bands.

23. A method according to claim 22 wherein said replacement band has a fastener on one of its ends, the method of attaching the replacement band end to end being performed by using the fastener to attach the replacement band to the selected one of the bands of the first and the second plurality of parallel bands.

24. A method according to claim 23 comprising the step of:

discarding the fastener after the replacement band is inserted into the position originally occupied by the selected one of the bands.

* * * * *